US010500861B2

(12) United States Patent
Uohashi et al.

(10) Patent No.: US 10,500,861 B2
(45) Date of Patent: Dec. 10, 2019

(54) METHOD FOR MANUFACTURING LIQUID EJECTION HEAD

(71) Applicant: CANON KABUSHIKI KAISHA, Tokyo (JP)

(72) Inventors: Kunihito Uohashi, Yokohama (JP); Shingo Nagata, Tokyo (JP); Kenji Fujii, Yokohama (JP); Jun Yamamuro, Yokohama (JP); Koji Sasaki, Nagareyama (JP); Keiji Matsumoto, Fukushima (JP); Seiichiro Yaginuma, Kawasaki (JP); Ryotaro Murakami, Yokohama (JP); Tomohiko Nakano, Kawasaki (JP); Masataka Nagai, Yokohama (JP)

(73) Assignee: Canon Kabushiki Kaisha, Tokyo (JP)

( * ) Notice: Subject to any disclaimer, the term of this patent is extended or adjusted under 35 U.S.C. 154(b) by 217 days.

(21) Appl. No.: 15/669,679

(22) Filed: Aug. 4, 2017

(65) Prior Publication Data

US 2018/0043689 A1 Feb. 15, 2018

(30) Foreign Application Priority Data

Aug. 12, 2016 (JP) ..... 2016-158891

(51) Int. Cl.
*B21D 53/00* (2006.01)
*B41J 2/16* (2006.01)

(52) U.S. Cl.
CPC ..... *B41J 2/1631* (2013.01); *B41J 2/162* (2013.01); *B41J 2/1603* (2013.01); *B41J 2/1632* (2013.01);
(Continued)

(58) Field of Classification Search
CPC ..... B41J 2/1603; B41J 2/162; B41J 2/1631; B41J 2/1632; B41J 2/1635; B41J 2/1639; B41J 2/1645
See application file for complete search history.

(56) References Cited

U.S. PATENT DOCUMENTS 7,429,099 B2 * 9/2008 Sugimoto ..... B41J 2/14233 347/68
7,571,985 B2 * 8/2009 Sanada ..... B41J 2/14233 347/50
(Continued)

FOREIGN PATENT DOCUMENTS

CN 1880080 A 12/2006
CN 103842179 A 6/2014
(Continued)

*Primary Examiner* — Paul D Kim
(74) *Attorney, Agent, or Firm* — Canon U.S.A., Inc. IP Division

(57) ABSTRACT

A method for manufacturing a liquid ejection head including providing a negative first photosensitive resin layer on the substrate, forming a pattern of the flow path by selectively exposing the first photosensitive resin layer, providing a negative second photosensitive resin layer on the first photosensitive resin layer, providing a negative third photosensitive resin layer on the second photosensitive resin layer, forming a pattern of the ejection port by selectively exposing the second and third photosensitive resin layers, developing the first, second, and third photosensitive resin layers, irradiating an activation energy line on at least the third photosensitive resin layer after the developing, and heat curing the first, second, and third photosensitive resin layers after the irradiating of the activation energy line.

13 Claims, 4 Drawing Sheets

(52) U.S. Cl.
CPC ..... *B41J 2/1635* (2013.01); *B41J 2/1639* (2013.01); *B41J 2/1645* (2013.01)

(56) References Cited

U.S. PATENT DOCUMENTS

| | | | | |
|---|---|---|---|---|
| 9,809,027 | B2 * | 11/2017 | Matsumoto | B41J 2/1628 |
| 2018/0170055 | A1 * | 6/2018 | Ishizuka | B41J 2/1603 |

FOREIGN PATENT DOCUMENTS

| | | | | |
|---|---|---|---|---|
| JP | H04216951 | A | | 8/1992 |
| JP | 2005254659 | A | | 9/2005 |
| JP | 2008062473 | A | | 3/2008 |
| JP | 2013230594 | A | * | 11/2013 |

* cited by examiner

METHOD FOR MANUFACTURING LIQUID EJECTION HEAD

BACKGROUND OF THE INVENTION

Field of the Invention

The disclosure relates to a method of manufacturing a liquid ejection head.

Description of the Related Art

A representative example of a liquid ejection head that ejects liquid includes an ink ejection head applied to an ink jet recording system that performs recoding by ejecting ink on a record medium. Typically, an ink ejection head includes ejection ports for ejecting ink, liquid chambers and flow paths that are in communication with the ejection ports, and energy generating elements that apply energy for ejecting the ink through the ejection ports.

By driving the energy generating elements, the ink ejection head ejects ink as droplets through the ejection ports to perform printing. Accordingly, the size and shape of the ejection ports have an effect on the ink ejection performance. In recent years, ink ejection heads are becoming micronized, and high-definition ejection ports capable of ejecting 5 pl or less ink, and thin ejection port forming members in which the heights of the flow paths are reduced and the lengths of the ejection ports are shortened are used.

In recent years, manufacturing processes of the flow paths and the ejection ports are becoming diverse. For example, the manufacturing processes include a method in which, after flow paths are formed in a flow path forming member, a plate member in which ejection ports are formed are adhered to the flow path forming member, and a method in which, after coating a negative material on a flow path mold formed of a positive material and forming ejection ports in the negative material, the flow path mold formed of the positive material is removed.

Japanese Patent Laid-Open No. 4-216951 discloses a method for manufacturing flow paths and ejection ports of a recording head by creating a difference in sensitivity to exposure between a first photosensitive resin layer forming the flow path and a second photosensitive resin layer forming the ejection port, and by performing exposure and development. In such a manufacturing method, exposure is performed after providing, on the substrate, the first photosensitive resin layer for forming flow paths so as to form a latent image of the pattern of the flow paths. Exposure is performed after providing, on the first photosensitive resin layer, the second photosensitive resin layer for forming ejection port forming members so as to form a latent image of the pattern of the ejection ports. The two photosensitive resin layers have a difference in sensitivities to exposure, and is characterized in that while an exposure dose exposes one of the photosensitive resin layers, the exposure dose does not expose the other photosensitive resin layer. Accordingly, even when the two photosensitive resin layers are undeveloped, each of the patterns of the photosensitive resin layers can be formed. The photosensitive resin layers are developed after the latent images are formed, and the flow paths and the ejection ports are shaped with the desired flow path forming members and the ejection port forming members.

In the method described in Japanese Patent Laid-Open No. 4-216951, as thinning of the flow path forming members and the ejection port forming members proceeds, the strength of the members decreases, and there are cases in which deformation of the members occur during the manufacturing process of the members. As a method of increasing the strength of the members, one can conceive of increasing the hardness of the members by forming the members using a thermosetting material and applying heat treatment thereto. However, as described in Japanese Patent Laid-Open No. 4-216951, in a case in which the flow path forming members and the ejection port forming members are formed by laminating two types of photosensitive polymers with different exposure sensitivities, when the hardness thereof is increased, the difference between the rates of shrinkage during heat curing may become large. When the difference between the rates of shrinkage of the members during heat curing becomes large, a deformation may occur in at least one of the members, and the substrate may become warped.

A method that suppresses such deformation and a warp from occurring may include matching the rates of shrinkage during heat curing of the photosensitive resin layers having different exposure sensitivities; however, it is difficult to prepare photosensitive polymers that have different and the desired characteristics, such as photosensitivity, and that have a similar heat cure shrinkage rate.

Furthermore, when the pattern of the ejection ports is formed in a negative photosensitive polymer, the strength of the ejection port forming members is increased by an increase in the exposure dose. However, the exposure sensitivity of the photosensitive resin layers for forming the flow path forming members needs to be reduced, and the photosensitive polymer material for forming the flow path forming members needs to be changed. Moreover, since the exposure dose needed when forming the pattern of the ejection ports increases, the tact increases.

Furthermore, in both the positive material and the negative material, strength can be increased by adding a thermosetting binder resin to the photosensitive resin layers for forming the ejection ports; however, depending on the added amount of the binder resin, there are cases in which the resolution is decreased, making it difficult to perform micromachining.

Meanwhile, in association with the micronization of the liquid ejection head, by changing the microstructure of the ejection ports in various ways, further functional improvement of the liquid ejection head and improvement in the manufacturing yield can be achieved. However, in the method described in Japanese Patent Laid-Open No. 4-216951, the ejection port forming members are formed from a single-layered photosensitive resin layer, such that when attempting to change the shape of the ejection ports in various ways, there are cases in which an addition of a complicated step is required.

SUMMARY OF ASPECTS OF THE DISCLOSURE

A method of manufacturing a liquid ejection head according to the disclosure is a method for manufacturing a liquid ejection head including a substrate provided with an energy generating element, a flow path forming member that forms a flow path, an ejection port forming member including an ejection port surface provided with an ejection port that ejects, with energy from the energy generating element, a liquid supplied from the flow path, the method of manufacturing the liquid ejection head including providing a negative first photosensitive resin layer on the substrate, forming a pattern of the flow path by selectively exposing the first photosensitive resin layer, providing a negative second photosensitive resin layer on the first photosensitive resin layer, providing a negative third photosensitive resin layer on the second photosensitive resin layer, forming a pattern of the ejection port by selectively exposing the second and third photosensitive resin layers, developing the first, second, and third photosensitive resin layers, irradiating an activation energy line on at least one of the second and third photosensitive resin layers after the developing, and heat curing the first, second, and third photosensitive resin layers after the irradiating of the activation energy line.

Further features and aspects of the disclosure will become apparent from the following description of numerous example embodiments with reference to the attached drawings.

DESCRIPTION OF THE EXAMPLE EMBODIMENTS

Figure 1:
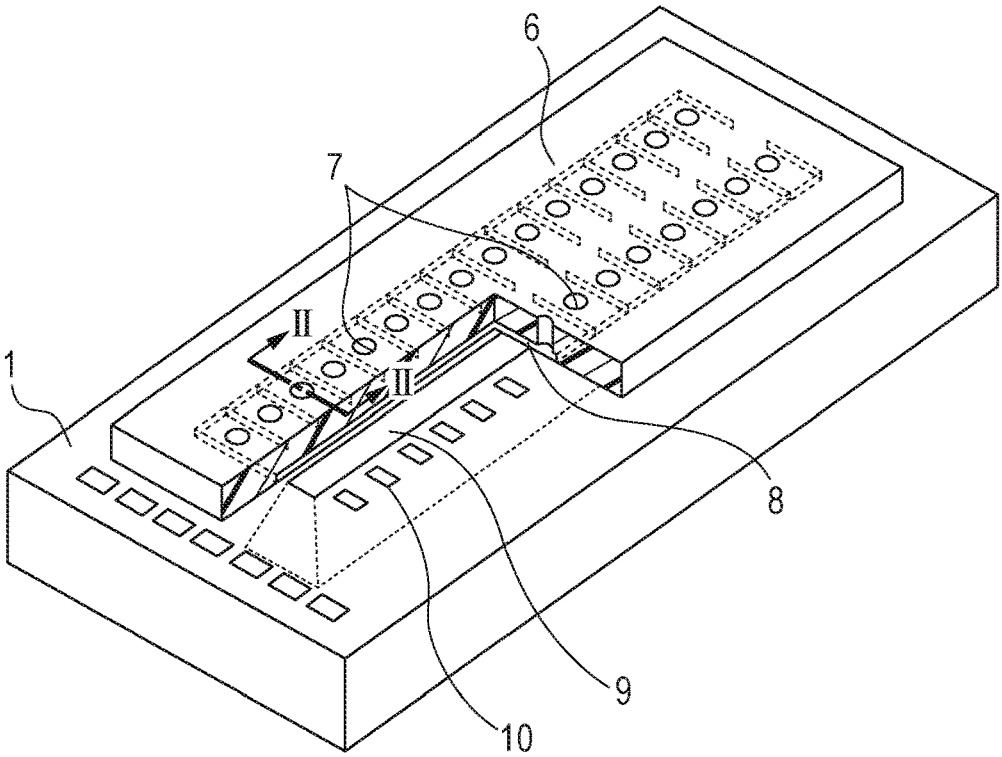
FIG. 1 is a schematic cross-sectional view illustrating an example of a configuration of a liquid ejection head.

The disclosure provides a method for manufacturing a liquid ejection head that is capable of managing increase in strength and micronization of the flow path forming members and the ejection port forming members without limiting selection of the materials for forming the flow path forming members and the ejection port forming members.

The disclosure provides also a method for manufacturing the liquid ejection head that is capable of changing the shapes of the ejection ports in accordance with the object without limiting selection of the materials forming the ejection port forming members, and without making the manufacturing process complex.

The liquid ejection head according to the disclosure includes a substrate on which an energy generating element is provided, a flow path forming member that forms a flow path, and an ejection port forming member including an ejection port surface. The ejection port surface is provided with the ejection port that ejects, with energy from the energy generating element, a liquid supplied from the flow path.

The ejection port surface of the ejection port forming member is the surface on the side on which the liquid is ejected from the liquid ejection head. The ejection port penetrates the ejection port forming member from the surface on the substrate side to the ejection port surface in the thickness direction of the ejection port forming member, and forms an opening in the ejection port surface. The liquid is ejected through the opening of the ejection port formed in the ejection port surface with the energy from the energy generating element. The ejection port surface includes a flat portion formed of a flat surface, and an opening edge portion that is in contact with the flat portion and that surrounds the opening of the ejection port.

An example method of manufacturing the liquid ejection head according to the disclosure includes the following steps:

(1) Providing a negative first photosensitive resin layer on the substrate.

(2) Forming a pattern of the flow path by selectively exposing the first photosensitive resin layer.

(3) Providing a negative second photosensitive resin layer on the first photosensitive resin layer.

(4) Providing a negative third photosensitive resin layer on the second photosensitive resin layer.

(5) Forming a pattern of the ejection port by selectively exposing the second and third photosensitive resin layers.

(6) Developing the first, second, and third photosensitive resin layers.

(7) Heat curing the developed first, second, and third photosensitive resin layers.

In the disclosure, since formation of the flow path forming member and the ejection port forming member are performed by developing the first to third photosensitive resin layers, a method for manufacturing a liquid ejection head in which the material forming each photosensitive resin layer can be selected and strength can be increased, and that can respond to micronization can be provided.

Furthermore, in the disclosure, since formation of the ejection port forming member is performed by exposing the second and third photosensitive resin layers, a method for manufacturing a liquid ejection head that is capable of responding when the material forming each photosensitive resin layer is selected and various changes in the shape of the ejection port are made.

Furthermore, the above effects can be obtained by widely selecting the materials for forming each of the first to third photosensitive resin layers from various commercially available or known materials.

The hardness of the first, second, and third photosensitive resin layers can be increased further with step (7) in which heat curing is performed after step (6) in which development is performed. As a result, even if micronization of the liquid ejection head, for example, thinning the flow path forming member and the ejection port forming member is promoted, deformation due to lack of strength thereof, peeling off of the layers from each other, deformation of the substrate, and the like can be prevented.

By combining materials that have different heat cure shrinkage rates as the materials forming the second photosensitive resin layer and the third photosensitive resin layer, the following step (6-1) can be added between step (6) and step (7).

(6-1) Irradiating the activation energy line onto at least either one of the developed second and third photosensitive resin layers, and controlling at least one of the heat cure shrinkage rates of the second and third photosensitive resin layers.

The second photosensitive resin layer and the third photosensitive resin layer form two layers in which the interfaces thereof are continuously in contact with and adjacent to each other. The difference between the heat cure shrinkage rates can be controlled through the exposure dose of the activation energy line in step (6-1).

Step (6-1) and step (7) may be separate steps, and step (7) may be performed after step (6-1) has been performed. Alternatively, step (6-1) and step (7) may be proceeded simultaneously.

Furthermore, the heat cure shrinkage rates of the second and third photosensitive resin layers may be controlled by irradiation of the activation energy line, and the shape of the ejection port may be variously changed in the following manner.

(I) By matching the heat cure shrinkage rates of the second and third photosensitive resin layers, deformation in the ejection formation member can be prevented. As a result, the ejection port surface including the opening edge portion of the ejection port can be a flat surface. Note that it is only sufficient that the flat surface is flat to an extent allowing the object performance of the liquid ejection head to be obtained. The criterion for the flatness is the position of the opening edge portion with respect to the level of the flat portion of the ejection port surface extending in a planar direction being, desirably, in the range between ±0.2 μm in the thickness direction of the ejection port forming member.

(II) A control in which the heat cure shrinkage rate of the third photosensitive resin layer is made larger than the heat cure shrinkage rate of the second photosensitive resin layer can be performed by irradiation of the activation energy line. By having the layers have such a difference in the heat cure shrinkage rates, a structure in which the opening edge portion protrudes in the thickness direction of the ejection port forming member with respect to the flat portion of the ejection port surface can be obtained.

(III) A control in which the heat cure shrinkage rate of the third photosensitive resin layer is made smaller than the heat cure shrinkage rate of the second photosensitive resin layer can be performed by irradiation of the activation energy line. By having the layers have such a difference in the heat cure shrinkage rates, a structure in which the opening edge portion is depressed in the thickness direction of the ejection port forming member with respect to the flat portion of the ejection port surface can be obtained.

Note that in the method for manufacturing the liquid ejection head according to the disclosure, at least three layers, namely, the first photosensitive resin layer for forming the flow path forming member, the second and third photosensitive resin layers for forming the ejection port forming member are used. Even if there is, to increase the hardness under the curing condition, a difference in the heat cure shrinkage rates between the three layers in the portions where the three layers are in contact with each other and are layered on each other, the flat portion that has the object flatness can be obtained with the second surface of the ejection port forming member. The above is because the stress generated by shrinkage during heat curing is reduced by the three-layered structure and, furthermore, because the first photosensitive resin layer adheres to both the substrate and the second photosensitive resin layer.

Hereinafter, an embodiment of a method for manufacturing a liquid ejection head according to the disclosure will be descried with reference to the drawings.

FIG. 1 is a schematic perspective view illustrating an example of a liquid ejection head that can be manufactured with the manufacturing method according to the disclosure. In the liquid ejection head illustrated in FIG. 1, a member 6 in which flow paths and ejection ports are formed is provided on a substrate 1 on which the energy generating elements 10 are provided. The substrate 1 includes a liquid supply path 9 penetrating the substrate 1 in the thickness direction. Liquid passing through the supply path 9 is further supplied to ejection ports 7 through flow paths 8 formed in the member 6. The substrate 1 is provided with wiring (not shown) for driving the energy generating elements 10, and a protective layer (not shown) that insulates and protects the energy generating elements and the wiring, for example.

Figure 2:
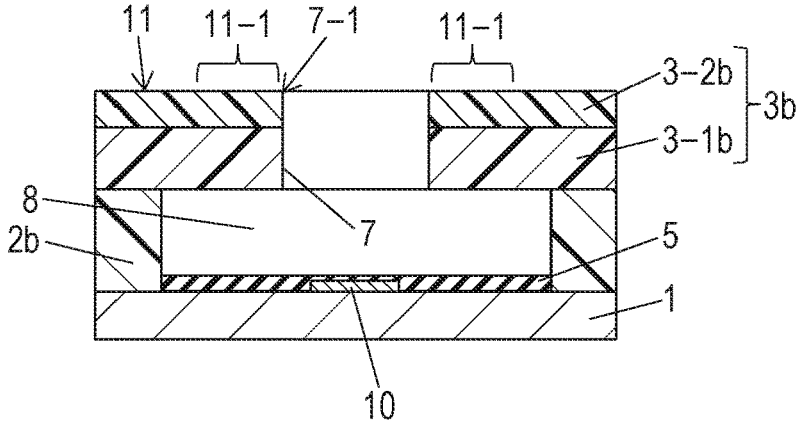
FIG. 2 is a schematic and partial cross-sectional view illustrating the example of the configuration of the liquid ejection head.
Figure 3A:
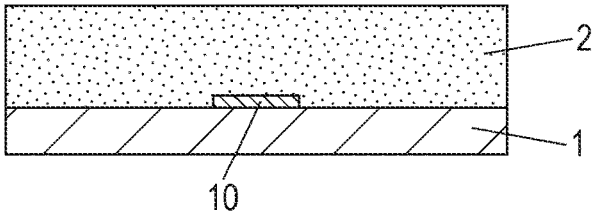
FIGS. 3A to 3H are schematic and partial cross-sectional views illustrating a method for manufacturing the liquid ejection head according to an aspect of the disclosure.
Figure 3B:
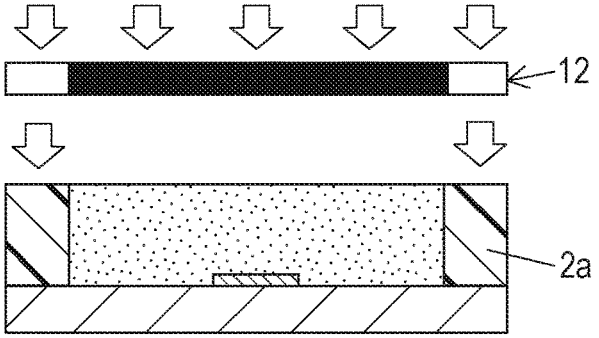
Figure 3C:
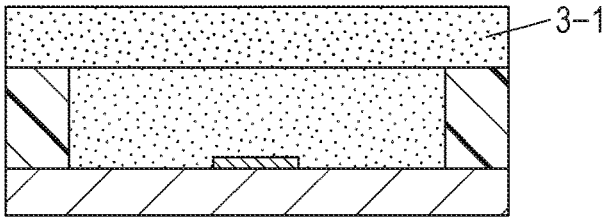
Figure 3D:
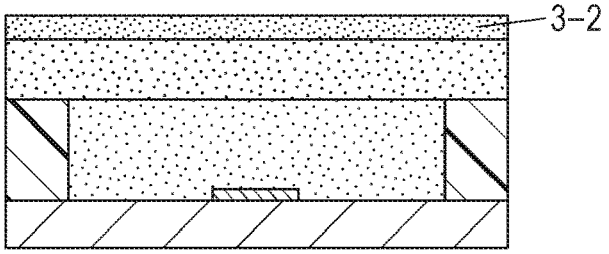
Figure 3E:
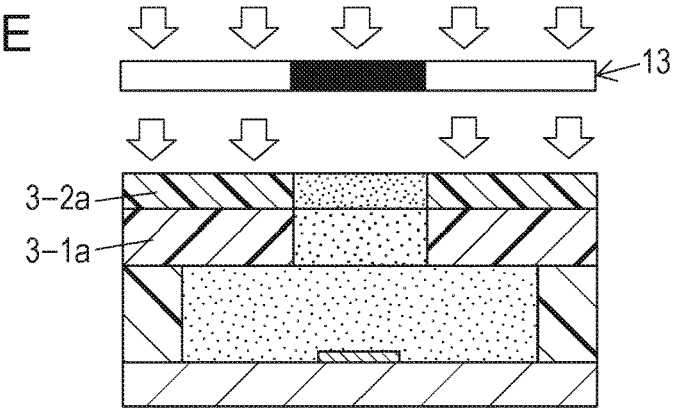
Figure 3F:
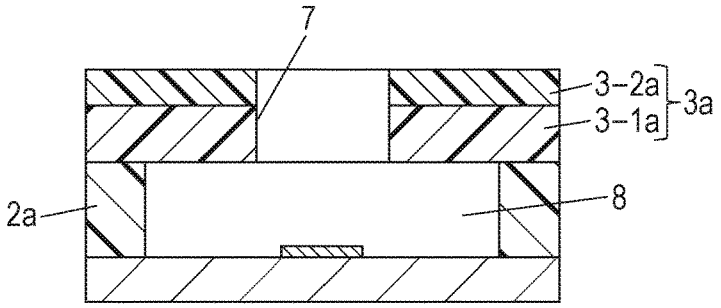
Figure 3G:
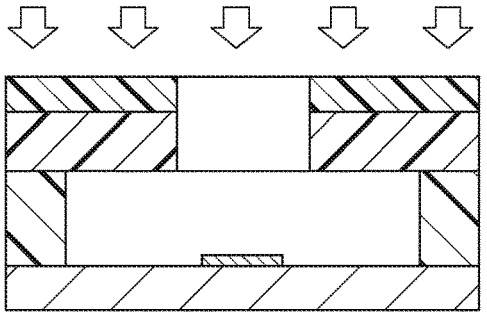
Figure 3H:
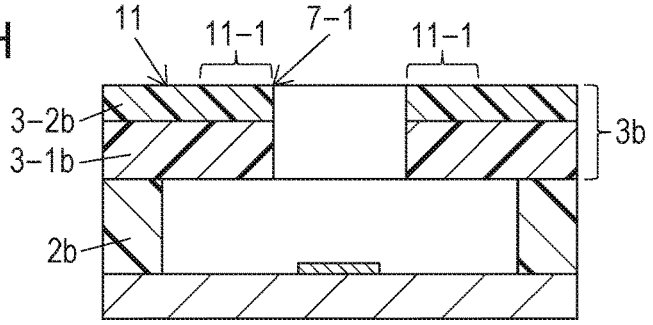

Referring to FIGS. 2 to 3H, an embodiment of a method of manufacturing an ink jet head according to the disclosure will be described next. Note that the method according to the disclosure is not limited to the method described below. FIG. 2 is a cross-sectional view taken along line II-II in FIG. 1 and schematically and partially illustrates a portion of the liquid ejection head where a flow path corresponding to an energy generating element is formed.

As illustrated in FIG. 2, the member 6 illustrated in FIG. 1 includes flow path forming members 2*b* and ejection port forming members 3*b*. Furthermore, each ejection port forming member 3*b* includes two layers, namely, a layer 3-1*b* and a layer 3-2*b* that are stacked in the thickness direction in this order from the substrate 1 side.

A pattern of the flow paths 8 are formed on the substrate 1 with the flow path forming members 2*b*. The ejection ports 7 are provided in the ejection port forming members 3*b* at positions corresponding to the portions where the energy generating elements 10 are disposed. The ejection port forming member 3*b* includes a first surface on the substrate 1 side, and an ejection port surface 11 serving as a second surface on the side opposite the first surface. The ejection port 7 penetrates the ejection port forming member 3*b* in the thickness direction thereof from the first surface of the ejection port forming member 3*b* to the ejection port surface 11 serving as the second surface. An opening of the ejection port 7 is provided in the ejection port surface 11, and an opening edge portion 11-1 including an edge portion 7-1 that connects an inner wall of the ejection port 7 and the ejection port surface 11 to each other is formed.

The wiring and the like (not shown) for driving the energy generating elements 10 are provided in the substrate 1. Liquid can be ejected from the openings of the ejection ports 7 on the ejection port surfaces 11 side of the ejection port forming members 3*b* by driving the energy generating elements 10 and applying energy for ejection to the liquid supplied into the flow paths 8.

As illustrated in FIG. 3A, first, a first photosensitive resin layer 2 formed of a negative first photosensitive resin composition is formed on the substrate 1 formed of silicon on which the energy generating element 10 has been formed. The energy generating element 10 may include an electrothermal conversion element, a piezoelectric element, or the like. Although a protective layer 5 is formed on the substrate 1 in FIG. 2, in FIGS. 3A to 4C, the protective layer 5 is omitted. For example, $SiO_2$ or the like may be used as the material of the protective layer 5. Note that the protective layer 5 may or may not be formed on the substrate 1 depending on the materials constituting the energy generating elements 10 and the wires (not shown) connected thereto.

A thermosetting chemically amplified resist can be used as the first photosensitive resin composition for forming the first photosensitive resin layer 2. At least one compound selected from an epoxy resin, a silicon-based high-molecular compound, a vinyl-based high-molecular compound containing a hydrogen atom in the alpha-position, or the like may be used as the resin component contained in the first photosensitive resin composition.

In the above compounds, epoxy resin is desirable as the resin component.

The epoxy resin may include a phenol novolak resin, a cresol novolac resin, or epoxidized rubber, such as epoxidized polybutadiene. One or more of the above kind may be used, or two or more of the above kind may be combined.

The first photosensitive resin composition may include a photoacid generating agent. Triarylsulfonium salt or onium salt, for example, may be used as the photoacid generating agent. One or more of the above kind may be used, or two or more of the above kind may be combined.

Moreover, the first photosensitive resin composition may further contain a solvent. Propylene glycol monomethyl ether acetate (hereinafter, referred to as PGMEA) or γ-butyrolactone, for example, may be used as the solvent. One or more of the above kind may be used, or two or more of the above kind may be combined. The boiling point of the solvent or the mixed solvent preferably ranges from 100° C. to 250° C., inclusive. Note that the literature values can be used as the boiling point.

The first photosensitive resin composition may be prepared using at least the resin component, the photoacid generating agent, and the solvent component. The composition related to the three components can be selected from the following ranges.

A rate of the resin component may range from 19.9 mass percent to 70.0 mass percent, inclusive, for example. A rate of the photoacid generating agent may range from 0.1 mass percent to 2.5 mass percent, inclusive, for example. A rate of the solvent or the mixed solvent serving as the solvent component may range from 29.9 mass percent to 80.0 mass percent, inclusive, for example.

The method for forming the first photosensitive resin layer 2 includes a solvent coating method or a method in which a dry film is fabricated and is transferred onto a substrate, for example. A solvent coating method is a method for forming a photosensitive resin layer by, after coating a photosensitive resin composition on the substrate by coating a resist solution with a spin coater, a roll coater, a wire bar, or the like, drying and removing the solvent. For example, the first photosensitive resin layer 2 can be formed by coating the solution described above containing the resin component, the photoacid generating agent, and the solvent component onto the substrate 1 by spin coating, and by drying the solution. Although not limited to a particular thickness, the thickness of the first photosensitive resin layer 2 may range from 5 μm to 30 μm, inclusive, for example.

A solubility parameter (an SP value) of the negative first photosensitive resin layer 2 preferably ranges from 5 to 13, inclusive. Note that in the disclosure, the SP value is a value estimated from a physical property. Specifically, assuming that an enthalpy of vaporization is ΔH, and a molar volume is V, since a solubility parameter δ is defined $\delta=\sqrt{(\Delta H-RT)/V}$, the physical property of each material can be estimated from literatures.

Subsequently, as illustrated in FIG. 3B, the pattern of the flow paths is formed as a latent image by selectively exposing the first photosensitive resin layer 2 through a mask 12, and then, post exposure bake (hereinafter, referred to as PEB) is performed. A cured portion 2*a* is formed in the first photosensitive resin layer 2 with the above. The pattern of the flow paths, formed of portions that have not been irradiated by light, is formed as the latent image in the above manner.

Ultraviolet rays, ionizing radiation, or the like, may be used in the exposure. The exposure dose is not limited to any particular amount as long as the desired pattern is formed; however, the exposure dose may range from 3000 J/m$^2$ to 10000 J/m$^2$, inclusive, for example. The temperature and the time of the PEB is not limited to any temperature or time as long as the desired pattern is formed; however, the temperature may be selected in the range from 40° C. to 105° C., inclusive, and the time may be selected in the range from 3 minutes to 15 minutes, inclusive.

Subsequently, as illustrated in FIG. 3C, a negative second photosensitive resin layer 3-1 is formed on the first photosensitive resin layer 2. A thermosetting chemically amplified resist can be used as the second photosensitive resin composition for forming the second photosensitive resin layer 3-1. At least one of the resin materials cited as the resin materials for the first photosensitive resin composition can be used as the resin component included in the second photosensitive resin composition. Furthermore, a resin material that is the same resin material contained in the first photosensitive resin layer and/or the third photosensitive resin layer can be used as the resin material contained in the second photosensitive resin composition. Furthermore, the second photosensitive resin composition may contain a photoacid generating agent. The photoacid generating agent may be any photoacid generating agent that is capable of forming the desired pattern, and at least one of the photoacid generating agents cited as the photoacid generating agents for the first photosensitive resin composition can be used. Furthermore, an acid generating agent that is the same as the acid generating agent contained in the first photosensitive resin layer and/or the third photosensitive resin layer can be used as the photoacid generating agent contained in the second photosensitive resin composition.

Moreover, the second photosensitive resin composition may further contain a solvent. For example, PGMEA or γ-butyrolactone may be used as the solvent. One or more of the above kind may be used, or two or more of the above kind may be combined. The boiling point of the solvent or the mixed solvent preferably ranges from 100° C. to 250° C., inclusive. Note that the solvent or the mixed solvent may be a solvent that is the same as the solvent contained in the first photosensitive resin composition and/or a third photosensitive resin composition.

The second photosensitive resin composition may be prepared using at least the resin component, the photoacid generating agent, and the solvent component. The composition related to the three components can be selected from the following ranges.

A rate of the resin component may range from 19.9 mass percent to 70.0 mass percent, inclusive, for example. A rate of the photoacid generating agent may range from 0.1 mass percent to 2.5 mass percent, inclusive, for example. A rate of the solvent or the mixed solvent serving as the solvent component may range from 29.9 mass percent to 80.0 mass percent, inclusive, for example.

The method for forming the second photosensitive resin layer 3-1 includes the solvent coating method or the method in which a dry film is fabricated and is transferred onto the substrate, for example. However, in a case in which the solvent contained in the second photosensitive resin composition may melt the first photosensitive resin layer 2 if coating is performed using the solvent coating method, then, a method in which a dry film of the second photosensitive resin composition is fabricated and is transferred onto the surface of the first photosensitive resin layer 2 on the substrate is desirable.

Although not limited to a particular thickness, the thickness of the second photosensitive resin layer 3-1 may range from 3 μm to 60 μm, inclusive, for example.

Subsequently, as illustrated in FIG. 3D, a negative third photosensitive resin layer 3-2 is formed on the second photosensitive resin layer 3-1. At least one of the resin materials cited as the resin materials for the first photosensitive resin composition can be used as the resin component included in the photosensitive resin composition used to form the third photosensitive resin layer 3-2. Furthermore, a resin material that is the same resin material contained in the first photosensitive resin layer and/or the second photosensitive resin layer can be used as the resin material contained in the third photosensitive resin composition.

Furthermore, the third photosensitive resin composition may contain a photoacid generating agent. The photoacid generating agent may be any photoacid generating agent that is capable of forming the desired pattern, and at least one of the photoacid generating agents cited as the photoacid generating agents for the first photosensitive resin composition can be used. Furthermore, an acid generating agent that is the same as the acid generating agent contained in the first photosensitive resin layer and/or the second photosensitive resin layer can be used as the photoacid generating agent contained in the third photosensitive resin composition.

Moreover, the third photosensitive resin composition may further contain a solvent. For example, ethanol or butanol may be used as the solvent. One of the above kind or a mixed solvent of two or more of the above kind may be used. The boiling point of the solvent or the mixed solvent is preferably 150° C. or lower. If the boiling point of the solvent or the mixed solvent exceeds 150° C., the solvent or the mixed solvent may permeate to the first photosensitive resin layer 2 and the shapes of the ejection ports may be deformed; accordingly, the boiling point is preferably 150° C. or lower. Note that the solvent or the mixed solvent may be a solvent that is the same as the solvent contained in the first photosensitive resin composition and/or the second photosensitive resin composition.

The third photosensitive resin composition may be prepared using at least the resin component, the photoacid generating agent, and the solvent component. The composition related to the three components can be selected from the following ranges.

A rate of the resin component may range from 1.0 mass percent to 70.0 mass percent, inclusive, for example. A rate of the photoacid generating agent may range from 0.1 mass percent to 2.5 mass percent, inclusive, for example. A rate of the solvent or the mixed solvent serving as the solvent component may range from 29.9 mass percent to 98.9 mass percent, inclusive, for example.

The method for forming the third photosensitive resin layer 3-2 includes the solvent coating method or the method in which a dry film is fabricated and is transferred onto a substrate, for example.

Although not limited to a particular thickness, the thickness of the third photosensitive resin layer 3-2 may range from 0.1 μm to 3 μm, inclusive, for example.

The difference between heat cure shrinkage rates of the second and third photosensitive resin compositions can be caused, at least, by either selecting the type of resin component or by the difference between the sensitivities.

From the viewpoint of maintaining the pattern of the flow paths formed with the cured portion 2*a* in the first photosensitive resin layer 2 as a latent image, desirably, the sensitivity of the second photosensitive resin layer 3-1 to exposure and the sensitivity of the third photosensitive resin layer 3-2 to exposure are higher than the sensitivity of the first photosensitive resin layer 2 to exposure. The difference between the sensitivities of the layers can be created through various methods. For example, a method in which the difference between the exposure sensitivities of the layers is created with photoacid generating agents that have different sensitivity to light, or a method in which the difference is created by the added amount of photoacid generating agent can be used. Furthermore, both of the above methods can be used together. Specifically, it is desirable that the second and third photosensitive resin compositions contain a photoacid generating agent with a sensitivity that is higher than that of the first photosensitive resin composition, or are composed so as to include a larger amount of photoacid generating agent.

In a case in which the photosensitivity is adjusted with the added amount of acid generating agent, the contained rate of the acid generating agent is adjusted in the second and third photosensitive resin layer so that when the pattern of the ejection ports is formed on the second and third photosensitive resin layers during the exposure, the second and third photosensitive resin layers are exposed and the first photosensitive resin layer is not exposed.

Furthermore, the amount of acid generating agent mixed in the first to third photosensitive resin layers is, preferably, set to an amount in which some are used in the step in which the above layers are selectively exposed, and in which at least some of the remaining acid generating agent can be used in the step of controlling the heat cure shrinkage rate described later. By addition of such an amount of acid generating agent, some of the unreacted acid generating agent in the selective exposure step can generate acid during irradiation of an activation energy line performed after development and facilitate polymerization during heat curing; accordingly, the strength of the heat cured object can be improved further.

Subsequently, as illustrated in FIG. 3E, the second photosensitive resin layer 3-1 and the third photosensitive resin layer 3-2 are selectively exposed through a mask 13 to form the latent image of the ejection ports and, subsequently, PEB is performed, such that the cured portions 3-1*a* and the 3-2*a* are formed in the layers. The pattern of the ejection ports formed at portions in the second photosensitive resin layer 3-1 and the third photosensitive resin layer 3-2 where no light has been irradiated is formed in the above manner. The exposure condition and the PEB condition are not limited to any conditions in particular as long as the desired pattern of the ink ejection ports can be formed. Ultraviolet rays or ionizing radiation, for example, may be used in the exposure. The exposure dose may range from 400 J/m$^2$ to 3000 J/m$^2$, inclusive, for example. The temperature and the time of the PEB may be selected in the range from 70° C. to 105° C., inclusive, and the time may be selected in the range from 3 minutes to 10 minutes, inclusive.

Subsequently, as illustrated in FIG. 3F, the first photosensitive resin layer 2, the second photosensitive resin layer 3-1, and the third photosensitive resin layer 3-2 are developed and the ejection port 7 and the flow path 8 are formed. For example, propylene glycol monomethyl ether acetate (PGMEA) may be used in the development.

Subsequently, as illustrated in FIG. 3G, an area including the ejection port 7 and the flow path 8 is exposed.

Activation energy lines such as, for example, ultraviolet rays or ionizing radiation that can control the heat cure shrinkage rate in accordance with the compositions of the second photosensitive resin layer and the third photosensitive resin layer can be used in the exposure. The exposure dose may range from 400 J/m$^2$ to 3000 J/m$^2$, inclusive, for example. The above exposure process is capable of controlling the heat cure shrinkage rate of at least either one of the cured portion 3-1*a* of the second photosensitive resin layer 3-1 that has been developed and the cured portion 3-2*a* of the third photosensitive resin layer 3-2 that has been developed that are created in the heat cure processing step described later.

The control of the heat cure shrinkage rate can be performed in accordance with the target shape of the ejection port. For example, the following control methods can be cited.

(A) The difference between the heat cure shrinkage rates of the cured portion 3-1*a* of the second photosensitive resin layer 3-1 that has been developed and the cured portion 3-2*a* of the third photosensitive resin layer 3-2 that has been developed is reduced such that the heat cure shrinkage rates match each other.

(B) The heat cure shrinkage rate of the cured portion 3-1*a* of the second photosensitive resin layer 3-1 that has been developed is set larger than the heat cure shrinkage rate of the cured portion 3-2*a* of the third photosensitive resin layer 3-2 that has been developed.

(C) The heat cure shrinkage rate of the cured portion 3-1*a* of the second photosensitive resin layer 3-1 that has been developed is set smaller than the heat cure shrinkage rate of the cured portion 3-2*a* of the third photosensitive resin layer 3-2 that has been developed.

Figure 4A:
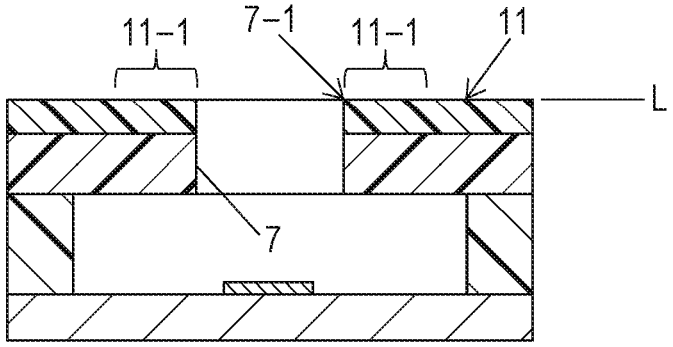
FIGS. 4A to 4C are schematic and partial cross-sectional views illustrating configuration examples of the liquid ejection head according to an aspect of the disclosure.

With the method described in (A), for example, as illustrated in FIG. 4A, the ejection port surface 11 can be formed as a planer surface in which a flat portion, which is formed of a flat surface, to the opening edge portion 11-1 can be planarized at a level L of the flat surface of the flat portion.

Figure 4B:
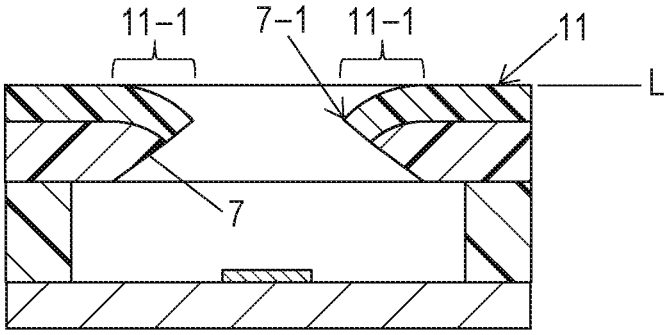

With the method described in (B), for example, as illustrated in FIG. 4B, a structure can be obtained in which the opening edge portion 11-1 is depressed with respect to the flat portion formed of the planner surface of the ejection port surface 11, or is depressed with respect to the level L of the flat surface of the flat portion.

Figure 4C:
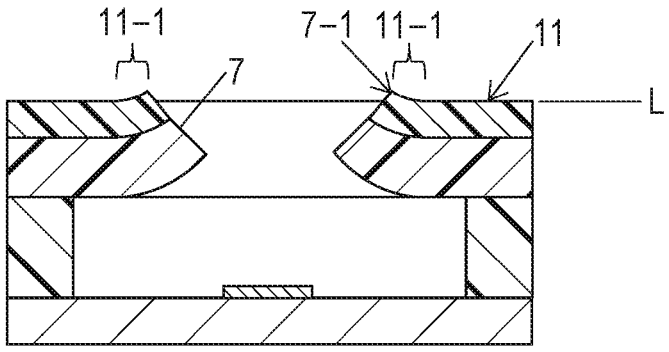

With the method described in (C), for example, as illustrated in FIG. 4C, a structure can be obtained in which the opening edge portion 11-1 protrudes from the flat portion formed of the planner surface of the ejection port surfaces 11, or protrudes above the level L of the flat surface of the flat portion.

The difference between the heat cure shrinkage rates of the cured object in the second photosensitive resin layer and the cured object in the third photosensitive resin layer that have been developed can be set in the range that allows the targeted shape of the ejection port to be obtained. The range of the difference between the heat cure shrinkage rates can be obtained theoretically with the materials forming the second photosensitive resin layer and the third photosensitive resin layer and with the heat cure condition, or can be obtained through experimental values.

The control of the heat cure shrinkage rate described above is, desirably, performed using the exposure dose of the activation energy line.

When an epoxy resin and a photoacid generating agent are used as the components of the photosensitive resin composition, ring opening occurs in the epoxy group remaining in the photosensitive resin layer at that time owing to irradiation of the activation energy line, and in accordance with the exposure dose, the amount of epoxy group in which the ring opening occurs increases such that hardening shrinkage at the time of thermal polymerization is facilitated. Accordingly, the rate of thermal hardening shrinkage can be, compared with a case in which the activation energy line is not irradiated, increased by irradiation of the activation energy line. In other words, by controlling the exposure dose, the amount of ring opening in the epoxy group can be controlled and the shape of the opening edge portion of the ejection port of the ejection port forming member can be controlled.

The exposure dose of the activation energy line for controlling the heat cure shrinkage rate can be, from the relationship between the change the in difference between the heat cure shrinkage rates of the cured object obtained from the second and third photosensitive resin layers that have been developed, selected so that the difference between the heat cure shrinkage rates satisfies either one of (A) to (C) described above. Furthermore, the relationship between the change in the difference between the heat cure shrinkage rates and the exposure dose of the activation energy line can be obtained theoretically or through experimental values.

The activation energy line for controlling the heat cure shrinkage rates can irradiate only the peripheral areas of the ejection port 7 and the flow path 8, or can irradiate the entire layered structure 3*a* including the selectively cured portions 3-1*a* and 3-2*a* of the second and third photosensitive resin layers.

The irradiation position of the activation energy line can be selected according to the target, such as in a case of a liquid ejection head having a plurality of ejection ports as illustrated in FIG. 1, or in a case of a multipiece fabrication in which a plurality of liquid ejection heads are fabricated on a common substrate and divided into each liquid ejection heads. In a case in which the control of the target heat cure shrinkage rate is performed simultaneously in all of the plurality of ejection ports 7, irradiation of the activation energy line is performed on the entire layered structure 3*a* formed on the substrate. In a case in which control of the target heat cure shrinkage rate is performed on some of the ejection ports, only a portion around some of the ejection ports (the portion around the flow path 8 of the cured portion 2*a* of the first photosensitive resin layer and the layered structure including and the cured portions 3-1*a* and 3-2*a*) are selectively exposed.

Note that in order to form the ejection port having the target shape, the second photosensitive resin layer and the third photosensitive resin layer need to be adhered to each other at the interfaces thereof. Furthermore, while the first photosensitive resin layer and the second photosensitive resin layer need to be adhered to each other in areas of the interfaces that are needed in forming the ejection port to have the target shape, other areas can be layered with other layers, such as an intermediate layer, interposed therebetween.

Subsequently, after performing irradiation of the activation energy line that controls the thermal hardening shrinkage rate, heating is performed on the cured portions 2*a* and 3*a* (3-1*a* and 3-2*a*). The temperature and the time of the heating are not limited to any particular temperature and time as long as an ink ejection head having the desired performance can be formed. For example, the temperature of the heating can range from 160° C. to 250° C., inclusive, and the time of the heating can range from 30 minutes to 5 hours, inclusive.

Note that the final cured object obtained from the third photosensitive resin layer on which heating has been performed forms the ejection port surface of the liquid ejection head on which cleaning is performed in the recording device. Accordingly, the resin component and/or composition of the third photosensitive resin composition used to form the third photosensitive resin layer may be selected so that the final cured object of the third photosensitive resin layer on which heating has been performed is water repellant as needed. As a composition having water repellency, a resin component and/or composition containing at least a cationic polymerizable perfluoroalkyl composition or perfluoropolyether composition may be selected.

The liquid ejection head including the structure in which the cured portion 2*b* that is on the substrate 1 and that has been further cured by heating, and an ejection port forming member 3*b* including the cured portions 3-1*b* and 3-2*b* are layered in the above order can be obtained in the above manner.

With the exposing step, which is performed after development, which performs either one of (A) to (C) described above with the activation energy line, and by heating, the ink ejection port can be formed to have the desired shape.

The shape of the ejection port illustrated in FIG. 4A can deal with a case in which flatness of the ejection port surface 11 is required.

The shape of the ejection port illustrated in FIG. 4B can deal with a case in which cleaning with a cleaning blade is performed where contact with the cleaning blade needs to be prevented.

The shape of the ejection port illustrated in FIG. 4C can deal with a case in which a plurality of ejection ports are formed on the same substrate where warping and peeling off of the portion including the substrate and the layered structure need to be prevented. The effect of preventing warping and peeling off from occurring is considered to happen due to the reduction in stress generated during heat curing, which is performed after development, at the cured portions in the first to third photosensitive resin layers formed by selective exposure. Using the above effect, generation of warpage of the substrate and the layers peeling off from each other can be prevented by intentionally providing portions illustrated in FIG. 4C in some of the plurality of ejection ports formed on the substrate, for example.

Subsequently, liquid supply ports that are in communication with the flow paths 8 are formed in the substrate 1, and the substrate 1 is cut with a dicing saw or the like to form separate chips. Subsequently, electrical connection for driving the ejection energy generating element 10 is established. Furthermore, a chip tank member for supplying liquid is connected to complete the liquid ejection head.

Ink for recording and printing, and liquid for various surface treatments can be used as the liquid for ejection.

EXAMPLES

First Example

Referring to FIGS. 3A to 3H, a method for manufacturing an ink ejection head according to a first example embodiment will be described.

FIGS. 3A to 3H are schematic and partial cross-sectional views illustrating the method for manufacturing the ink ejection head according to the present example embodiment.

As illustrated in FIG. 3A, a negative photoresist 2 (hereinafter, referred to as a resist 2) serving as the first photosensitive resin layer was first formed.

A silicon substrate was used as the substrate 1. Energy generating elements 10 serving as the electrothermal conversion elements, and a protective layer (not shown) containing $SiO_2$ was provided on the substrate 1. Wiring and the like (not shown) for driving the energy generating elements 10 were further provided on the substrate 1. The resist 2 serving as the first photosensitive resin layer was formed by coating a solution containing a resin component formed of epoxy resin (product name: SU-8, manufactured by Nippon Kayaku), a solvent formed of PGMEA, a photoacid generating agent formed of triarylsulfonium salt, and an acid deactivator formed of amine compound by spin coating, and by performing drying.

The acid deactivator is a component that reacts with a strong acid generated from the acid generating agent and that relatively suppresses reaction by generating a weak acid.

The film thickness of the resist 2 was 7 μm. The rate of the resin component contained in the resist 2 was 60 mass percent, the rate of the photoacid generating agent was 0.75 mass percent, the rate of the acid deactivator was 0.25 mass percent, and the rate of the solvent was 39 mass percent. In other words, the amount of residual solvent of the resist 2 was 39 mass percent. Furthermore, the softening point of the resist 2 was about 70° C.

Subsequently, as illustrated in FIG. 3B, the resist 2 was selectively exposed with the pattern of the flow paths through the mask 12 using an exposure device and, subsequently, post exposure bake (PEB) was performed. Ultraviolet rays were used for the exposure. The exposure dose was 10000 ($J/m^2$). PEB was performed for 10 minutes at 60° C. The flow path pattern formed of a portion that had not been irradiated by light was formed in the resist 2 in the above manner.

Subsequently, as illustrated in FIG. 3C, a negative photoresist 3 (hereinafter, referred to as a resist 3) serving as the second photosensitive resin layer 3-1 was formed on the resist 2. The resist 3 is a dry film of a resist containing a resin component formed of epoxy resin (same as the resist 2 described above), a solvent formed of PGMEA, and a photoacid generating agent formed of triarylsulfonium salt. The rate of the resin component contained in the resist before being formed into the dry film was 50 mass percent, the rate of the solvent was 49 mass percent, and the rate of the photoacid generating agent was 1 mass percent. The above resist was dried to form the dry film. The amount of solvent of the resist 3, in other words, the amount of residual solvent was 0.1 mass percent. Furthermore, the softening point of the resist 3 was about 70° C. The resist 3 was formed by dry film transfer with a laminate. The transfer temperature was 55° C., and the transfer time was 1 minute. The film thickness of the resist 3 was 4 μm.

Subsequently, as illustrated in FIG. 3D, a resist 4 serving as the third photosensitive resin layer 3-2 was formed on the resist 3. The resist 4 is a resist containing a resin component formed of epoxy resin, a solvent formed of ethanol, a photoacid generating agent formed of triarylsulfonium salt, and a fluorine-based water repellant component. Epoxy (Epikote 828) manufactured by Yuka Shell Epoxy, EHPE (manufactured by Daicel Chemical Industries), or the like can be used as the epoxy resin for the resist 4.

The rate of the resin component contained in the resist 4 was 10 mass percent, the rate of the solvent was 89 mass percent, and the rate of the photoacid generating agent was 1 mass percent.

Note that in the present example, in order to form the flow paths and the ejection port pattern with a latent image, the resists 3 and 4 contained a larger amount of photoacid generating agent than the resist 2 such that the resist 2 had low sensitivity and the resists 3 and 4 had high sensitivity.

The resist 4 was formed with a solvent coating method using a die coater. The drying temperature was 60° C., and the drying time was 10 minutes. The film thickness of the resist 4 was 0.6 μm. Note that the heat cure shrinkage rates of the resin contained in the resist 3 and the resin contained in the resist 4 used in the present example were different. An index indicating the heat cure shrinkage rate is a rate of shrinkage per unit volume before and after performing heating at the same temperature and for the same time period (the rate (%) of the volume after the shrinkage with respect to the volume per unit before the shrinkage).

In the present example, under heating conditions at 220° C. for 2 hours, the rate of shrinkage of the resin contained in the resist 3 was 99%, and the rate of shrinkage of the resin contained in the resist 4 was 89%.

Note that a linear expansion coefficient (a negative expansion) of the resin material that is the rate (%) of the length after the shrinkage with respect to the unit length before the shrinkage can be used as the index of the heat cure shrinkage rate of the resin component.

Subsequently, as illustrated in FIG. 3E, the resists 3 and 4 were selectively batch exposed with the pattern of the ejection ports through the mask 13 using an exposure device and, subsequently, PEB was performed. Ultraviolet rays were used for the exposure. The exposure dose was 1000 ($J/m^2$). PEB was performed for 10 minutes at 105° C. The ejection port pattern formed of portions that had not been irradiated by light was formed in the resists 3 and 4 in the above manner.

Subsequently, as illustrated in FIG. 3F, the resists 2 to 4 were developed simultaneously. Developing was performed using PGMEA. The ejection ports 7 and the flow paths 8 were formed with the above.

Subsequently, as illustrated in FIG. 3G, the resists 2 to 4 that had been developed simultaneously were exposed simultaneously, and the heat cure shrinkage rates thereof were adjusted. Ultraviolet rays were used for the exposure. The exposure dose was 800 ($J/m^2$).

Subsequently, heating was performed on the cured portion 2*a*, 3-1*a*, and 3-2*a* obtained from the resists 2 to 4. A hot drying oven was used for heating, heating was performed for 2 hours at 220° C., and the flow path forming members 2*b* and the ejection port forming members 3*b* were obtained.

The second surfaces (the ejection port surfaces) 11 of the ejection port forming members 3*b* were formed as flat surfaces illustrated in FIGS. 3H and 4A by heat curing after the adjustment of the heat cure shrinkage rates had been performed with the exposure described above. The flat surface included the opening edge portion 11-1 in which the amount of displacement of the depression or the protrusion of the edge portion 7-1 of the ejection port was 0.2 μm or less.

Subsequently, after forming, in the substrate 1, the supply ports (not shown) that are in communication with the flow paths 8 and that penetrate the substrate 1, the substrate 1 was cut with a dicing saw to form separate chips, and electrical connections for driving the ink ejection energy generating elements 10 were established. Subsequently, the chip tank member for supplying liquid was connected to complete the liquid ejection head.

Second Example

Other than the exposure dose being set to 400 ($J/m^2$) during the exposure for adjusting the heat cure shrinkage rates illustrated in FIG. 3G, a liquid ejection head was fabricated in a manner similar to the first example. As a result, the opening edge portion 11-1 having a shape in which the edge portion 7-1 is, as illustrated in FIG. 4B, depressed 1.2 μm was obtained.

Third Example

Other than the exposure dose being set to 2200 ($J/m^2$) illustrated in FIG. 3G, a liquid ejection head was fabricated in a manner similar to the first example. As a result, the opening edge portion 11-1 having a shape in which the edge portion 7-1 is, as illustrated in FIG. 4C, protruded 1.1 μm was obtained.

While the disclosure has been described with reference to example embodiments, it is to be understood that the invention is not limited to the disclosed example embodiments. The scope of the following claims is to be accorded the broadest interpretation so as to encompass all such modifications and equivalent structures and functions.

This application claims the benefit of Japanese Patent Application No. 2016-158891, filed Aug. 12, 2016, which is hereby incorporated by reference herein in its entirety.

What is claimed is:

1. A method for manufacturing a liquid ejection head including a substrate provided with an energy generating element, a flow path forming member that forms a flow path, an ejection port forming member including an ejection port surface provided with an ejection port that ejects, with energy from the energy generating element, a liquid supplied from the flow path, the method of manufacturing the liquid ejection head comprising:

providing a negative first photosensitive resin layer on the substrate;

forming a pattern of the flow path by selectively exposing the first photosensitive resin layer;

providing a negative second photosensitive resin layer on the first photosensitive resin layer;

providing a negative third photosensitive resin layer on the second photosensitive resin layer;

forming a pattern of the ejection port by selectively exposing the second and third photosensitive resin layers;

developing the first, second, and third photosensitive resin layers;

irradiating an activation energy line on at least one of the second and third photosensitive resin layers after the developing; and heat curing the first, second, and third photosensitive resin layers after the irradiating of the activation energy line.

2. The method of manufacturing the liquid ejection head according to claim 1, wherein the ejection port surface is a flat surface.

3. The method of manufacturing the liquid ejection head according to claim 2, wherein a difference between heat cure shrinkage rates of the second photosensitive resin layer and the third photosensitive resin layer is reduced by irradiation of the activation energy line.

4. The method of manufacturing the liquid ejection head according to claim 1, wherein the ejection port surface includes a flat surface and an opening edge portion of the ejection port, the opening edge portion being depressed from the flat surface in a thickness direction of the ejection port forming member.

5. The method of manufacturing the liquid ejection head according to claim 4, wherein a heat cure shrinkage rate of the third photosensitive resin layer is made smaller than a heat cure shrinkage rate of the second photosensitive resin layer by irradiation of the activation energy line.

6. The method of manufacturing the liquid ejection head according to claim 1, wherein the ejection port surface includes a flat surface and an opening edge portion of the ejection port, the opening edge portion being protruded from the flat surface in a thickness direction of the ejection port forming member.

7. The method of manufacturing the liquid ejection head according to claim 6, wherein a heat cure shrinkage rate of the third photosensitive resin layer is made larger than a heat cure shrinkage rate of the second photosensitive resin layer by irradiation of the activation energy line.

8. The method of manufacturing the liquid ejection heat according to claim 1, wherein a heat cure shrinkage rate of the third photosensitive resin layer before irradiation of the activation energy line is smaller than a heat cure shrinkage rate of the second photosensitive resin layer before the irradiation of the activation energy line.

9. The method of manufacturing the liquid ejection head according to claim 1, wherein the activation energy line is irradiated on an entire surface of the third photosensitive resin layer.

10. The method of manufacturing the liquid ejection head according to claim 1, wherein the second and third photosensitive resin layers are in contact with each other.

11. The method of manufacturing the liquid ejection head according to claim 1, wherein the heat curing and the irradiating of the activation energy line are performed simultaneously.

12. The method of manufacturing the liquid ejection head according to claim 1, wherein an exposure sensitivity of the first photosensitive resin layer is lower than exposure sensitivities of the second and third photosensitive resin layers.

13. The method of manufacturing the liquid ejection head according to claim 1, wherein a cured object of the third photosensitive resin layer is water repellant.

* * * * *